United States Patent [19]

Bowman

[11] 4,132,095

[45] Jan. 2, 1979

[54] AUTOMATIC GAUGE CONTROL METHOD AND APPARATUS FOR TANDEM STRIP MILLS

[75] Inventor: Richard J. Bowman, Middletown Township, Bucks County, Pa.

[73] Assignee: United States Steel Corporation, Del.

[21] Appl. No.: 821,888

[22] Filed: Aug. 4, 1977

[51] Int. Cl.[2] ..... B21B 37/08; H03K 25/02

[52] U.S. Cl. ..... 72/8; 72/19; 72/21; 307/221 D

[58] Field of Search ..... 72/6–12, 72/16, 20, 21; 307/221 C, 221 D

[56] References Cited

U.S. PATENT DOCUMENTS

| | | | |
|---|---|---|---|
| 3,357,217 | 12/1967 | Wallace et al. | 72/8 |
| 3,416,339 | 12/1968 | List | 72/8 |
| 3,492,844 | 2/1970 | Silva | 72/8 |
| 3,553,991 | 1/1971 | Chope | 72/8 |
| 3,566,639 | 3/1971 | Dornbusch | 72/8 |
| 3,613,419 | 10/1971 | Silva | 72/8 |

FOREIGN PATENT DOCUMENTS

| | | | |
|---|---|---|---|
| 48-17144 | 6/1970 | Japan | 72/16 |

*Primary Examiner*—Milton S. Mehr
*Attorney, Agent, or Firm*—Walter P. Wood

[57] ABSTRACT

A method and apparatus for automatically controlling the gauge of metal strip rolled in a tandem strip mill. Load cells installed on a first stand generate signals representative of changes in the roll-separating force, and hence of gap error, at this stand. Such signals are fed-forward, with a delay to allow for transport time of the strip minus screw-reaction time, to a second stand to effect screw adjustment of the latter. Signals representative of gap error at the second stand, corrected for changes in the position of the screws at the second stand, are fed-forward to effect screw adjustment at a third stand, etc. The screws of the first stand are maintained at their original setting, while adjustments in the screws of succeeding stands made in response to changes in the roll-separating force are effected exclusively by signals fed-forward from a preceding stand.

The invention also includes an improved method and apparatus for delaying transmission of analog signals for controlled intervals without need for converting the analog signals to digital signals.

16 Claims, 5 Drawing Figures

AUTOMATIC GAUGE CONTROL METHOD AND APPARATUS FOR TANDEM STRIP MILLS

This invention relates to an imroved method and apparatus for automatically controlling the gauge of metal strip rolled in a tandem strip mill, and to an improved method and apparatus for delaying transmission of analog signals for controlled intervals.

BACKGROUND OF THE INVENTION

In the operation of a conventional tandem strip mill, a metal slab or bar, heated to a suitable hot-rolling temperature. is introduced to the first of a series of roll stands and passes successively through the other stands, which reduce it in steps to strip form. In each stand the gap between rolls is smaller than in the preceding stand and the rolls are driven at a faster rate to handle the lengthening strip. Each stand is equipped with screws and screwdown motors for adjusting the relative position of the rolls and the size of gap between rolls. When a strip is actually between the rolls of a stand, the roll housings stretch. Hence during a rolling operation the actual gap is the algebraic sum of the setting obtained by adjustment of the screws and the stretch in the roll housings.

In setting up the mill, the positions of the rolls are adjusted beforehand to provide gaps which are smaller than the desired gap to allow for stretch in the housings when the strip is between the rolls. As the housings stretch, the gap becomes approximately correct for rolling strip of the desired gauge. In roll stands other than the first the rolls may be set "below face"; that is, the rolls are in contact and actually stretching the housings even though no strip is present.

Conventionally an X-ray gauge is used to scan the strip as it leaves the last stand. If the strip is off-gauge, the X-ray gauge generates a signal which automatically operates the screwdown motors of some or all the stands to correct the gauge error. Adjustments thus obtained would maintain the rolls at proper setting only if there were no variations in the physical characteristics of the strip. In practice a strip becomes progressively cooler, and hence harder, from its leading end to its trailing end. This fact necessitates tightening the screws progressively throughout a rolling operation to maintain the gaps at the proper size. Apart from normal cooling, the strip has portions of lower temperature than normal as a result of contact of the original slab or bar with skids in the reheating furnace, or other heat absorbing objects. When such cooler portions are between the rolls of a stand, the magnitude of force tending to separate the rolls increases. Any change in the roll-separating force changes the stretch in the roll housings and, unless corrected, changes the roll gap and produces a gauge error in the strip.

To correct gap errors which would be caused by variations in the strip, it is known to equip the mill with automatic gauge control (AGC) apparatus, and there are numerous patents showing such apparatus. Essentially AGC apparatus includes load cells installed on some or all the stands to measure the roll-separating force, and electronic circuits and sometimes a digital computer connected to the load cells and to certain of the screwdown motors. As the strip becomes progressively harder along its length, or when a portion of the strip between the rolls has characteristics other than normal, the load cells generate signals which effect screw adjustments at one or more stands. Thus AGC apparatus maintains the roll gap at the adjusted stands at its desired constant size, as corrected by signals from the X-ray gauge, despite variations in the roll-separating force.

In one form of AGC apparatus used heretofore, the load cells of a first stand N are tied to the screwdown motors of the same stand. If the roll-separating force at this stand increases, the screwdown motors of this stand operate in a direction to tighten the screws at this stand. This leads to a problem that tightening the screws further increases the roll-separating force. Hence the screwdown motors must be stopped short of full correction to prevent their "running away". To obtain full correction, one or more following stands N + 1, N + 2, etc. operate as slave stands, whereby their screwdown motors operate in response to signals from the first or master stand N to effect the same or larger screw adjustments. Reference can be made to Wallace et al. U.S. Pat. No. 3,357,217 for a showing of an AGC apparatus which operates in this fashion.

Other earlier forms of AGC utilize a partial feed-forward principle. Load cells installed on one stand N, detect changes in the roll-separating force at this stand, produce signals which effect screw adjustments at this same stand, and transmit signals representative of such changes to following stands N + 1, N + 2, etc., where they may effect further screw adjustments. Transmission of the signals to following stands is delayed to allow for transport time of the strip between stands, but to the best of my knowledge the reaction time of the screws has not been taken into account. Such AGC apparatus are said to overcome certain problems encountered with the AGC apparatus of the master-slave type described above. Reference can be made to Coleman et al. U.S. Pat. No. 3,448,600, Masar U.S. Pat. No. 3,702,071, or Smith U.S. Pat. No. 3,709,008 for showings. Reference also can be made to Arimura et al. U.S. Pat. No. 3,677,045, Fox et al. U.S. Pat. No. 3,841,123, Peterson et al. U.S. Pat No. 3,848,443, or Fox U.S. Pat. No. 3,851,509 for other AGC showings.

Whenever gap-error signals generated at the first few stands are fed-forward to effect screw adjustments at a succeeding stand, the adjustment must be delayed until the portion of the strip for which an adjustment is needed arrives at the stand where the adjustment is to be made. Delay means used heretofore have been unduly complex and costly. The load cell on a roll stand generates analog voltage signals representative of changes in the roll-separating force from normal. Usually the analog signals have been converted to digital signals, and the digital signals have been delayed and converted back to analog signals to operate the screwdown motors. The AGC apparatus shown in the aforementioned Coleman et al. patent is an example.

In addition to adjusting the roll gap to control strip gauge, the tension in the strip may be adjusted to effect gauge control. Conventional tandem strip rolling mills usually include one or more loopers between roll stands. These loopers can be used to vary the tension in the strip and to assist in gauge control, since increasing the tension produces a thinner strip. This practice is undesirable since tensioning the strip not only reduces the gauge, but also reduces the width, which should be held constant.

SUMMARY OF THE INVENTION

The present invention affords AGC method and apparatus which operate exclusively on a feed-forward principle. Measurements are taken of the roll-separating force at the first stand of a tandem strip mill, and signals representative of changes in the roll-separating force, that is, of gap error, are fed forward to the second stand. If the error is of sufficient magnitude to warrant correction, the screwdown motors of the second stand commence to operate after a delay to allow for transport time of the strip between stands, minus screw-reaction time. The screwdown motors of the second stand continues to operate until a signal representative of the changed screw position cancels the gap-error signal. The roll gap at the first stand is set beforehand and is not adjusted during the rolling operation. Measurements are taken of the roll-separating force at the second stand, and any signals of gap-error are fed-forward to the third stand, but are corrected by subtracting signals representative of changes in the screw position at the second stand. This avoids compounding any error detected at the second stand. The same steps may be repeated in feeding-forward gap-error signals from the third stand to a fourth stand, etc. As distinguished from prior practice, adjustments made at any stand in response to changes in the roll-separating force are effected exclusively by signals fed-forward from a preceding stand, never by measurements made at the same stand.

The invention also affords an improved method and apparatus for delaying transmission of analog signals from one stand to another in which the analog signals are delayed through a multiplexer without need for converting them to digital signals and back again. This part of the invention is useful for many purposes in addition to its use in AGC apparatus.

OBJECTS OF THE INVENTION

An object of the invention is to provide an improved AGC apparatus and method which operate exclusively on a feed-forward principle and which are simpler and afford more accurate control of strip gauge than master-slave or partial feed-forward AGC arrangements used heretofore.

A further object is to provide an improved feed-forward AGC apparatus and method which avoid compounding gauge errors as error signals are transmitted from one stand to another.

A more specific object is to provide an improved AGC method and apparatus in which signals representative of changes in roll-separating force or gap-error are taken at a first stand of a tandem strip mill, the signals are fed-forward to effect screw adjustments in a second stand without effecting adjustments in the first stand, similar signals are taken at the second stand, corrected by signals representative of changes in the screw position at the second stand, and are fed-forward to effect screw adjustments in a third stand, etc., and in which the signals are delayed to allow for transport time of the strip between stands, minus screw-reaction time.

A further object is to provide an improved method and apparatus for delaying transmission of analog signals for controlled intervals without need for converting the analog signals to digital signals.

DETAILED DESCRIPTION OF THE PREFERRED EMBODIMENT

Figure 1:
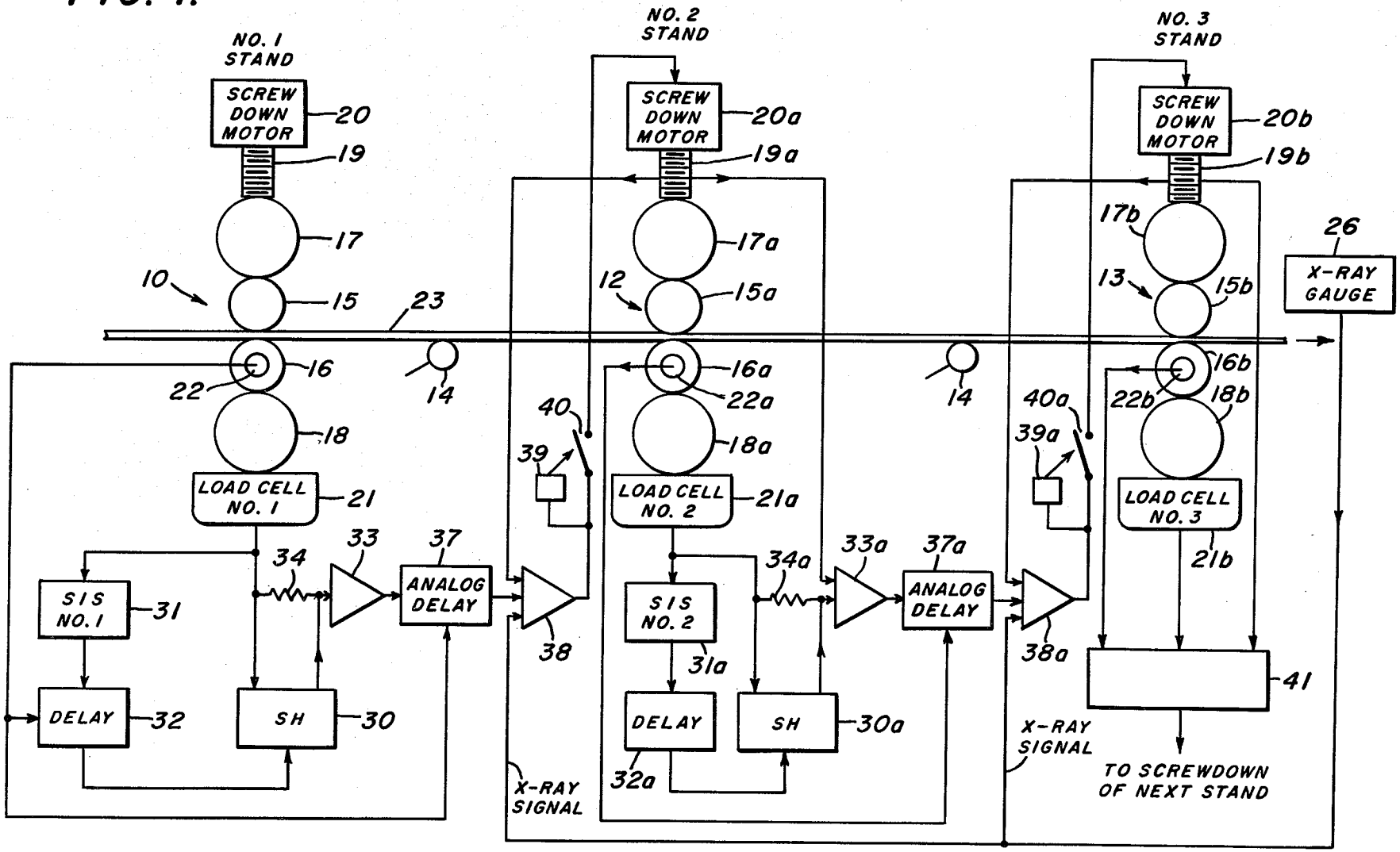
FIG. 1 is a diagrammatic side elevational view of three stands of an otherwise conventional tandem strip mill equipped with AGC apparatus in accordance with the present invention.

FIG. 1 shows diagrammatically first, second and third stands 10, 12 and 13 of a tandem strip mill which may be conventional apart from the AGC apparatus of the present invention. The mill usually includes additional stands, for example six altogether, but the additional stands and the AGC apparatus applied thereto would be similar. Conventional loopers 14 are located between stands. The first stand 10 includes upper and lower work rolls 15 and 16, upper and lower backup rolls 17 and 18, screws 19, and screwdown motors 20. The motors have conventional control circuits (not shown) and are operatively connected with the screws for effecting screw adjustment and thereby adjusting the relative position of the rolls and the size of gap between the upper and lower work rolls 15 and 16. The first stand is equipped with load cells 21 which generate voltage signals proportional in magnitude to the separating force between the work rolls. A tachometer-generator 22 is connected to one of the work rolls and generates voltage signals representative of the strip speed. The second and third stands 12 and 13 include similar parts identified by the same reference numerals with suffixes "a" and "b" respectively. A metal strip 23 is shown within the mill.

In accordance with usual practice, a conventional X-ray gauge 26, which is located at the exit side of the last roll stand, scans the strip to detect gauge errors. When a gauge error appears, the X-ray gauge transmits signals to some or all the roll stands to effect screw adjustments. Preferably in a mill equipped with AGC apparatus of the present invention, signals from the X-ray gauge go to all the stands except the first stand 10, and adjustments to correct the gauge are distributed equally among the stands.

The AGC apparatus of my invention embodies a number of individual integrated circuits. FIG. 1 shows these circuits only in block diagram, and they are described only in general terms in connection with FIG. 1. More detailed showings and descriptions appear hereinafter.

The work rolls 15 and 16 of the first stand 10 are not set below face and the voltage signal from load cells 21 is zero before a strip 23 enters the stand. As soon as the leading end of the strip enters the bite of the work rolls, the load cells transmit a positive voltage signal (for example 5 volts) to a "sample-and-hold" (SH) circuit 30, which at this time is in its "sample" mode. The signal from the load cells goes also to a "strip-in-stand" (SIS) circuit 31, which transmits a signal via a delay circuit 32 to the SH circuit 30. Several feet of strip at the leading end are expected to be quite irregular and ultimately are scrapped. No effort is made to control the gauge of this portion of the strip. The delay circuit receives strip-speed signals from the tachometer-generator 22 to adjust automatically the length of time the signal from the SIS circuit is delayed. Conveniently the length of strip on which the gauge is not controlled equals about half the distance between stands. For example, the stands may be 18 feet apart, and the gauge of the first 9 feet is not controlled. As soon as this length of strip has passed the first stand, and strip of normal characteristics reaches the stand, the delayed signal from the SIS circuit 31 switches the SH circuit 30 to its "hold" mode.

The SH circuit 31 inverts the voltage signal from the load cells 21 and transmits the resulting negative signal to a summing amplifier 33, which is adjusted beforehand for the particular width, gauge and grade of the strip. The load cells 21 transmit a positive voltage signal via a resistor 34 to the summing amplifier 33. The positive and negative voltage signals cancel each other, whereby the summing amplifier normally transmits a zero output signal. From this point on any signal from the summing amplifier is only a gap-error signal indicated by changes in the roll-separating force at the first stand. Such gap-error signals are fed-forward to effect adjustment of the screws **19*a* of the second roll stand 12, as hereinafter explained, but do not effect any adjustment of the screws of the first stand 10**.

Gap-error signals from the summing amplifier 33 and speed signals from the tachometer-generator 22 go to an analog delay circuit 37 constructed in accordance with my invention and hereinafter fully described. The analog delay circuit delays feeding-forward of any signal from the summing amplifier for an interval equal to the transport time of the strip 23 from the first stand 10 to the second stand 12, minus the screw-reaction time of the second stand. The transport time of course varies with the strip speed, but the screw-reaction time is constant, for example, about one second.

Delayed gap-error signals from the summing amplifier 33 go to another summing amplifier 38, which amplifies the signal to a suitable magnitude for actuating the control circuits of the screwdown motors **20*a* of the second stand. Before signals from the summing amplifier 38 go to the screwdown motors, they go to a "minimum-error" or "dead-band" circuit 39, such as is commonly used in AGC apparatus. The latter controls a normally open switch 40 located between the summing amplifier 38 and the screwdown motors 20*a* of the second roll stand 12. If a change in the roll-separating force at the first stand is too small to be significant, such as may be caused by vibration or roll eccentricity, the resulting gap-error signal is of insufficient magnitude to actuate the minimum-error circuit, and switch 40 remains open. If a gap error is large enough to warrant correction, the minimum-error circuit closes switch 40 and the signal from the summing amplifier goes to the control circuits of screwdown motors 20*a*, whereupon the screwdown motors are energized to adjust the screws 19*a*** up or down depending on the polarity of the signal.

The summing amplifier 38 also receives a screw-position signal fron the screws **19*a*. This signal may be obtained by conventional means, for example selsyn indicators, or equivalent position encoders. This signal is of opposite polarity to the gap-error signal from the summing amplifier 33. When the screwdown motors have adjusted the screws 19*a* up or down to the extent necessary to correct the gap error, the screw-position signal reaches the same magnitude as the gap-error signal and cancels this signal, whereupon the screwdown motors stop. Gauge-error signals from the X-ray gauge 26 also go to the summing amplifier 38 whereby signals from the X-ray gauge operate the screwdown motors 20*a*** in like manner until canceled by screw-position signals. Corrections effected by gauge-error signals from the X-ray gauge correct any error in the gaps originally set by the operator.

The second stand 12 is equipped with a series of circuits similar to those of the first stand 10 and identified by the same reference numerals with a suffix "a". The work rolls of the second and subsequent stands may be set below face and this necessitates a more elaborate SIS circuit than in the first stand, as hereinafter explained. The summing amplifier **33*a* of the second stand receives in addition to the gap-error signal a screw-position signal representative of any change which has been made in the position of the screws 19*a* of the second stand. The summing amplifier subtracts the screw-position signal from the gap-error signal and feeds-forward a corrected or net gap-error signal to the control circuit of the screwdown motors 20*b* of the third stand 13. It is important, and I believe novel, to subtract the screw-position signal from the gap-error signal before the signal is fed-forward to the next stand so that any signals reaching the next stand represent only gap error. Otherwise any gauge errors in the strip leaving the second stand would be compounded in subsequent stands. The third stand 13 is equipped with circuits similar to those of the second stand 12 for feeding-forward gap-error signals to a fourth stand, etc., but in the interest of simplicity, these circuits are represented by a single block 41**. However the analog delay feature may be omitted in subsequent stands where the strip travels at a high rate of speed and transport time is less than screw-reaction time.

SAMPLE-AND-HOLD CIRCUITS

Figure 2:
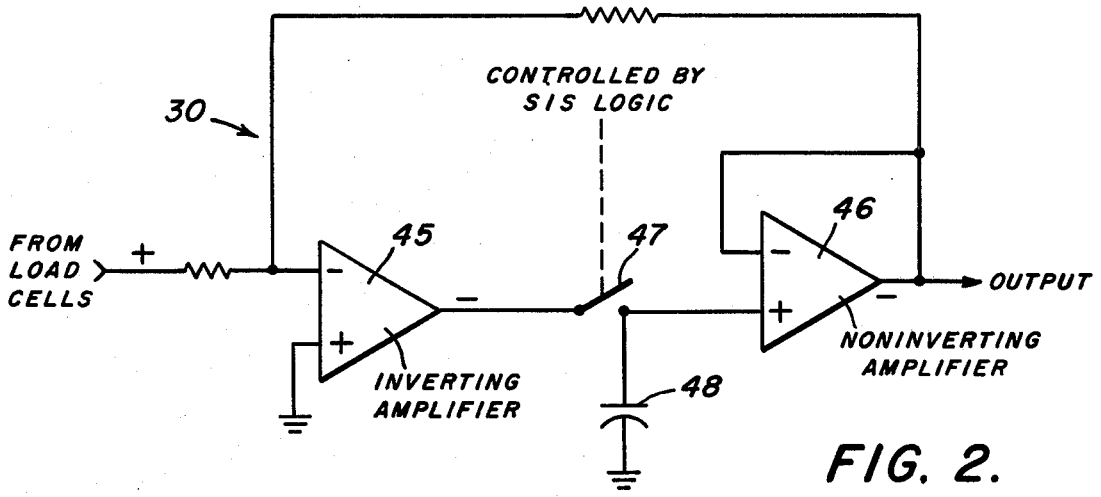
FIG. 2 is a schematic diagram of a "sample-and-hold" (SH) circuit which may be embodied in the apparatus.

The SH circuits 30, **30*a*, etc. and the SH components embodied within the SIS circuits hereinafter described per se are known devices. One example of a suitable SH circuit or component is available commercially from Harris Semiconductor Division, Harris Corporation, Melbourne, Florida, as the Harris HA2425. FIG. 2 illustrates the principle schematically. The circuit includes inverting and noninverting amplifier 45 and 46 respectively and a logic-controlled switch 47 connected between the amplifiers. A capacitor 48 is connected between the output side of the switch and ground. Switch 47** is closed when the circuit is in its "sample" mode, and opens when the circuit goes into its "hold" mode.

Voltage signals from the respective load cells 21, **21*a*, etc. go to both amplifiers 45 and 46. As long as the circuit is in its "sample" mode, an inverted output signal from amplifier 45 goes to amplifier 46, where it cancels the signal from the load cells. The inverted output signal serves also to charge the capacitor 48. Thus the charge follows the output voltage of the amplifier. When switch 47 opens, amplifier 46 receives a constant voltage from capacitor 48, which voltage continues to oppose the voltage from the load cells. The voltage from the capacitor is of a magnitude equal to but opposite the voltage signal from the load cells with a strip between the rolls but no gap error in the stand. This voltage cancels the portion of the load cell voltage signal attributed to normal separating force on the rolls, whereby the output voltage from amplifier 46** is representative of gap error only.

STRIP-IN-STAND CIRCUITS

Figure 3:
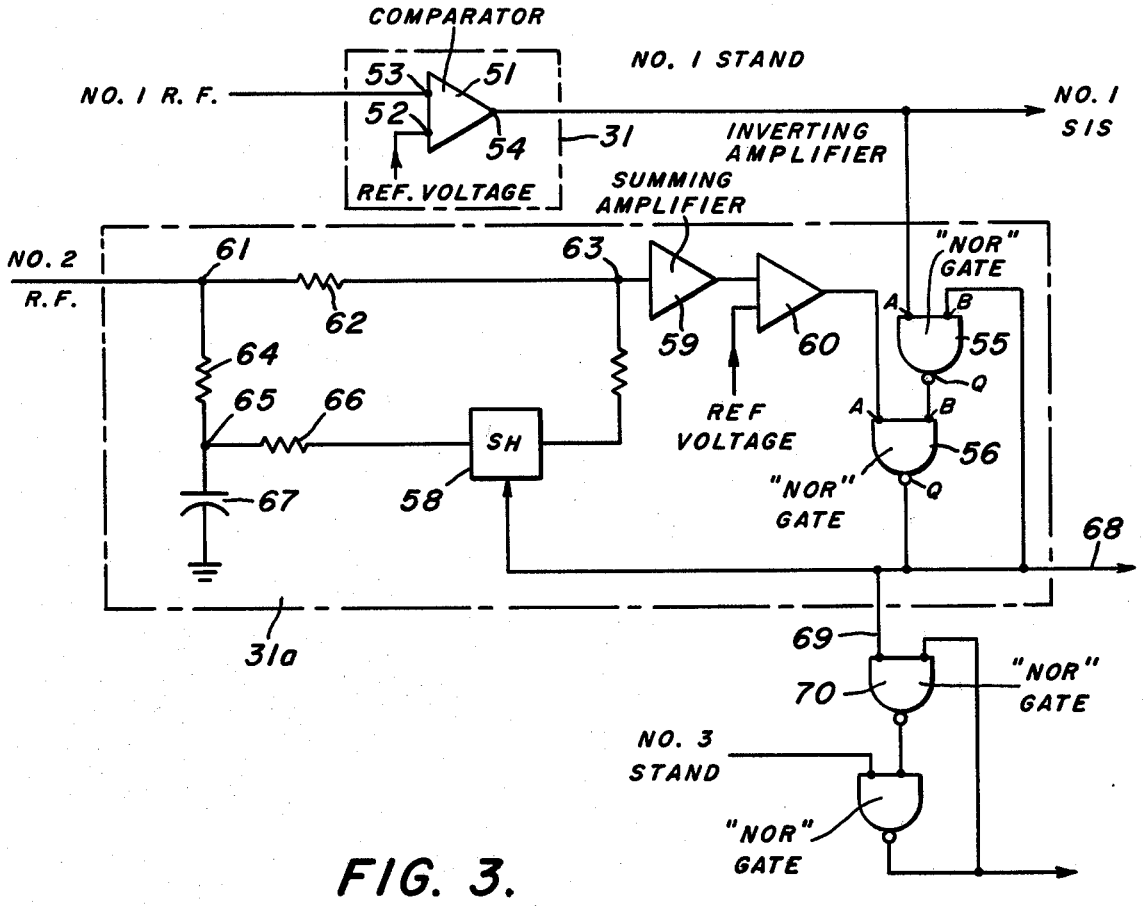
FIG. 3 is a schematic diagram of a "strip-in-stand" (SIS) circuit which may be embodied in the apparatus.

The aforementioned Mazar U.S. Pat. No. 3,702,071 describes several arrangements for signifying the presence of a strip in a roll stand. The work rolls 15 and 16 of the first stand 10 never are set below face, and any of the arrangements described in the patent may be used as the SIS circuit 31. The work rolls of the other stands may be set below face, and these stands require SIS circuits which ignore voltage signals from the load cells attributed to the setting of the rolls. FIG. 3 shows schematically the SIS circuit 31 and 31*a* of the first and second stands 10 and 12. The SIS circuits of the following stands may be similar to 31*a*.

The SIS circuit 31 of the first stand 10 is illustrated simply as a comparator 51 which has a reference voltage terminal 52, an input terminal 53, and an output terminal 54. A comparator is an amplifier whose output has only two states, "on" or "off". As long as the voltage applied to the input terminal is less than the voltage applied to the reference terminal, the output terminal voltage is zero. When a strip 23 enters the bite of the work rolls 15 and 16, the voltage applied to the input terminal 53 goes from zero to a magnitude at least as great as the reference voltage, whereupon a positive voltage appears at the output terminal 54.

The SIS circuit 31*a* of the second stand 12 includes two "nor" gates 55 and 56 each of which has two input terminals A and B and an output terminal Q. A "nor" gate transmits an output voltage only when zero voltage is applied to both its input terminals. The output terminal 54 of the comparator 51 is connected to the input terminal A of the "nor" gate 55. The output Terminal Q of each "nor" gate is connected to the input terminal B of the other "nor" gate. As long as the voltage from the comparator is zero, the voltage at both input terminals of the "nor" gate 55 is zero, and a voltage is transmitted from its output terminal Q to the input terminal B of the "nor" gate 56. Consequently the latter "nor" gate transmits no voltage back to the input terminal "B" of the "nor" gate 55. When the comparator 51 transmits a voltage to the input terminal A of the "nor" gate 55 signifying that a strip is within the first stand, this gate ceases to transmit a voltage to the input terminal B of the "nor" gate 56, whereupon a voltage appears at the output terminal Q of the latter gate. The output voltage signal from the comparator 51 goes also to the SIS logic of the first stand 10 to actuate the delay circuit 32 and ultimately to shift the SH circuit to its "hold" mode.

The SIS circuit 31*a* includes a SH component 58 (not to be confused with the SH circuit 30*a*), to which component the output terminal Q of the "nor" gate 56 is connected. The SIS circuit also includes a summing amplifier 59 and an inverted comparator 60. Normally the inverted comparator transmits a voltage, but it ceases to transmit a voltage whenever a voltage greater than the reference voltage is applied to its input terminal. If the rolls 15*a* and 16*a* are set below face, the load cells 21*a* transmit a voltage at all times via a junction point 61 and resistor 62 to a summing junction point 63 in advance of the amplifier 59. The same voltage is transmitted from the junction point 61 via a resistor 64, junction point 65 and resistor 66 to the input terminal of the SH component 58, now in its "sample" mode. The SH component inverts the voltage and transmits the inverted voltage to the junction point 63, where it cancels the voltage received via resistor 62. Hence in the absence of a strip in the second stand, no voltage reaches the amplifier 59, and no voltage is transmitted to the input terminal of the inverted comparator 60.

When a strip enters the second stand, the load cells 21*a* transmit an immediate higher level voltage signal via the junction point 61 and resistor 62 to the summing junction point 63 and thence to the amplifier 59. The load cells also transmit the same higher level voltage signal via resistor 64, junction point 65 and resistor 66 to the input terminal of the SH component 58. A capacitor 67 is connected between the junction point 65 and ground. Because of the RC time constant of the resistor 64 and capacitor 67, the voltage at point 65 does not change as rapidly as at point 61. The difference in timing of the two signals produces a momentary condition in which the inverted voltage from the SH component 58 does not cancel the voltage received at point 63 via resistor 62. Consequently there is an output voltage transmitted from amplifier 59 to the inverted comparator 60, and the output from the latter goes to zero. The output terminal of the comparator is connected to the input terminal A of the "nor" gate 56, which now commences to transmit a voltage from its output terminal Q. The resulting voltage signal shifts the SH component 58 to its "hold" mode, and transmits signals via a conductor 68 to the delay circuit 32*a*, and via a conductor 69 to a "nor" gate 70 of the SIS circuit of the third stand 13. The amplifier 59 continues to transmit a voltage to the inverted comparator 60, since the inverted voltage transmitted by the SH component 58 in its "hold" mode is only the lower voltage which results from the roll setting.

When the trailing end of the strip clears the first stand 10, the output voltage transmitted from comparator 51 to the "nor" gate 55 goes to zero. When the trailing end clears the second stand 12, the voltage applied to the amplifier 59 drops to the original level which results from the setting of the rolls below face. The inverted comparator 60 transmits a voltage to the input terminal A of the "nor" gate 56. The voltage at the output terminal of the "nor" gate 56 goes to zero and resets the SH component 58 to its "sample" mode. A voltage appears at the output terminal of the "nor" gate 55.

It is seen that the voltage signal which is transmitted to the SIS circuit 31*a* by reason of the below-face setting of rolls 15*a* and 16*a* is ineffective for transmitting any voltage signal from the circuit even though this voltage is applied at all times. The circuit transmits no voltage signal until there is a sudden increase in the voltage applied thereby by reason of the entry of a strip to the second stand.

DELAY CIRCUIT 32

Figure 4:
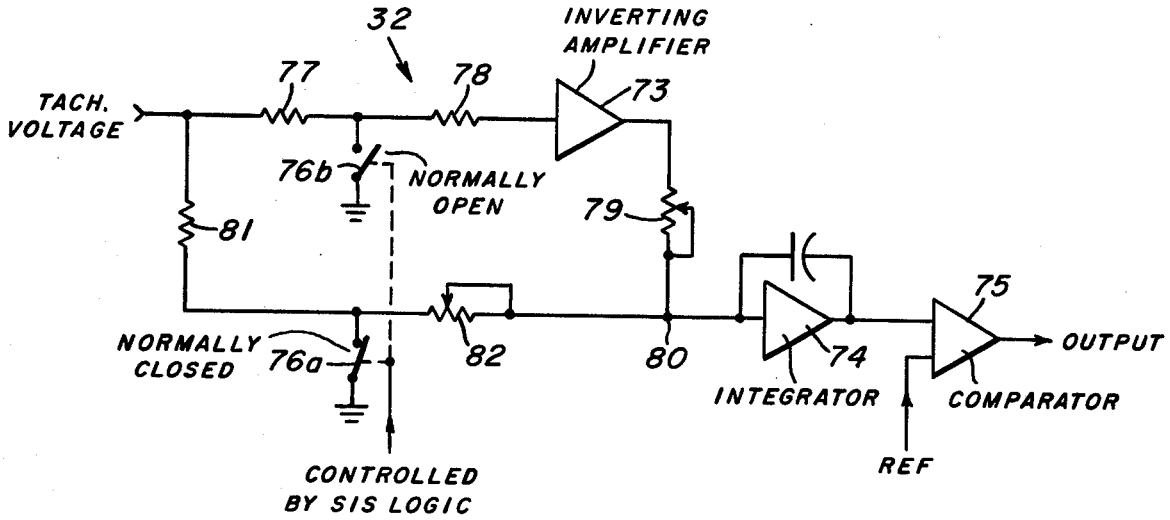
FIG. 4 is a schematic diagram of one form of delay circuit which may be embodied in the apparatus.

FIG. 4 shows schematically the principle of the delay circuit 32 which delays signals from the SIS circuit 31 to the SH circuit 30 until the irregular portion at the leading end of a strip passes the first stand 10. Corresponding circuits of the other stands are similar. The circuit 32 provides a delay which varies with the strip speed, but is not required to pass on a signal of varying voltage level like the analog delay circuit 37.

Circuit 32 includes an inverting amplifier 73, an integrator 74, a comparator 75 and a two-pole switch having normally closed contacts 76*a* and normally open contacts 76*b*. When no strip is within the first roll stand, a positive voltage signal from the tachometer-generator goes through resistors 77 and 78 to the inverting amplifier 73. A negative output signal from the amplifier goes through a resistor 79 and junction point 80 to the integrator 74. The negative voltage at point 80 causes the output of the integrator to charge positive at a rate dependent on the magnitude of the voltage signal, which of course varies with the mill speed. A pair of resistors 81 and 82 provide a parallel path for the voltage signal to reach point 80 directly, but the normally closed contacts 76a short-circuit this path to ground, whereby the only signal reaching point 80 is the inverted signal from amplifier 73.

When the strip enters the first stand, the SIS logic opens contacts 76a and closes contacts 76b. This short-circuits the path through the inverting amplifier 73, but enables the positive voltage signal from the tachometer generator to reach point 80 via resistors 81 and 82 without inversion. The positive voltage at point 80 now causes the output of the integrator 74 to charge negative, again at a rate dependent on the magnitude of the voltage signal or the mill speed.

As the integrator charge passes through zero while its polarity is changing, the comparator 75 transmits a voltage which shifts the SH circuit. As already stated, the shift is to the "hold" mode as strip is entering and to the "sample" mode as strip is leaving. The resistors 72 and 89 are adjustable to enable adjustments to be made in the length of strip for which no gauge control is exercised. In practice the switch 76a, 76b is of the solid-state type, but is illustrated as a conventional switch for simplicity.

ANALOG DELAY CIRCUIT

Figure 5:
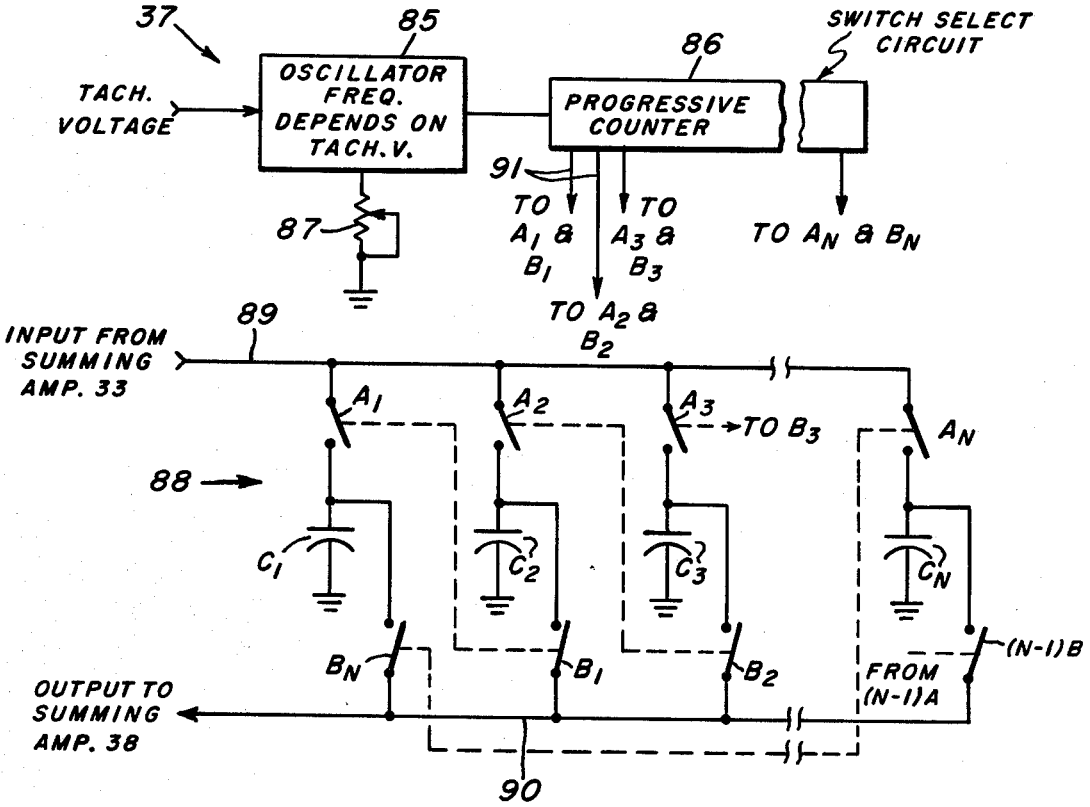
FIG. 5 is a schematic diagram of my improved circuit for delaying analog signals.

FIG. 5 shows schematically my improved analog delay circuit 37 for delaying transmission of gap-error voltage signals of varying level for intervals which vary with the strip speed. This circuit may be useful in other applications in which there is a need to delay voltage signals of varying magnitude for varying intervals, and its use is not limited to AGC apparatus.

The delay circuit includes a voltage controlled oscillator 85 which receives an input voltage signal from the tachometer-generator 22 of a magnitude varying with the strip speed. The oscillator transmits a series of pulses to a progressive counter 86. The pulse frequency varies with the voltage level. A potentiometer 87 is connected to the oscillator 85 to adjust the frequency and thereby adjust the interval for which screw adjustments are delayed.

The delay circuit includes a multiplexer 88 or a pair of such multiplexers coupled in series. The multiplexers provide a plurality of parallel capacitors $C_1$, $C_2$, $C_3$. . . $C_N$. . One side of each capacitor is connected through normally open contacts $A_1$, $A_2$, $A_3$. . . $A_N$ to an input conductor 89. The same side of capacitor $C_1$ is connected through normally open contacts $B_N$ to an output conductor 90. In like manner capacitor $C_2$ is connected through contacts $B_1$, capacitor $C_3$ through contacts $B_2$ etc. to the output conductor 90. Contacts $A_1$ and $B_1$ open and close together, and likewise $A_2$ and $B_2$, $A_3$ and $B_3$ etc. In each instance the A contacts are connected to the capacitor C of the same number, and the B contacts to the next capacitor in line. The other side of each capacitor is connected to ground.

The progressive pulse counter 86 has a plurality of output conductors 91 connected to the multiplexer 88. Each conductor 91 carries a pulse in turn to the mutiplexer as the pulses are counted. As each conductor 91 carries a pulse, the corresponding contacts $A_1$ and $B_1$, $A_2$ and $B_2$, $A_3$ and $B_3$, etc. close momentarily in turn. The input conductor 89 is connected to the summing amplifier 33, and the output conductor 90 to the summing amplifier 38. Assume conductor 89 carriers a voltage signal of a level representing a gap-error of a magnitude which warrants correction. As contacts $A_1$ and $B_1$ close, capacitor $C_1$ charges to the level of the voltage signal and for the time holds its charge, since contacts $B_N$ are open. If there is a charge on capacitor $C_2$ from the preceding operating cycle, a corresponding voltage is applied through contacts $B_1$ to the output conductor 90. The charge on capacitor $C_1$ remains until the cycle is complete and contacts $A_N$ and $B_N$ close, whereupon the charge is transmitted through the output conductor 90.

The voltage controlled oscillator, progressive pulse counter and multiplexer per se are known devices. Examples of suitable devices which are available commercially are the RCA CD4046 volage controlled oscillator, the Fairchild 4520 binary coded decimal counter, and the Harris HI 506A-5 multiplexer. The Harris multiplexer provides only 16 counts, but I can couple two in series to obtain 32 counts and thus obtain a count for approximately each six inches of strip. In practice the contacts $A_1$ and $B_1$ etc. are solid state switches, but FIG. 5 shows conventional switch contacts for simplicity.

The formula for adjusting the pulse frequency from the oscillator 85 is as follows:

$$\text{Frequency} = \frac{(\text{strip speed} \times \text{distance between stands}) - \text{screw reacting time}}{\text{number of counts available}}$$

For example, assume a strip speed of 1 foot per second, stands 18 feet apart, a screw reaction time of 1 second, and 32 counts available.

$$\text{Frequency} = \frac{(1 \times 18) - 1}{32} = 0.53 \text{ pulses per second}$$

From the foregoing description it is seen that my invention affords a relatively simple AGC method and apparatus which are highly accurate. In contrast with prior practice, my AGC operates exclusively on a feed-forward principle. It avoids any need to sense the strip temperature, since the first roll stand in effect gives an in depth temperature measurement. The invention overcomes any need for a digital computer, since the analog delay circuit operates throughout on analog voltage signals. The invention also prevents compounding of errors by taken into account adjustments already made in any stand before transmitting gap-error signals to the next stand.

I claim:

1. In a tandem strip mill which includes a plurality of roll stands, each of said stands comprising:

a respective pair of work rolls having a gap therebetween through which a strip passes during a rolling operation, the presence of the strip between the rolls producing a separating force on the rolls, which force varies with characteristics of the strip;

respective means for adjusting the relative position of the rolls and the size of gap therebetween; and respective means for measuring the separating force;

the combination therewith of an improved automatic gauge control apparatus comprising:

means operatively connected with the force-measuring means of one or more of said stands for generating and feeding-forward to a succeeding stand signals representing gap-error exclusively as indicated by changes in the separating force;

the means for feeding gap-error signals forward including means for delaying the signals to allow for transport time of the strip from the stand at which the force is measured to the succeeding stand, minus the reaction time of the adjustment means of the succeeding stand; and means operatively connected with the succeeding stand for operating the adjustment means thereof in response to the signals;

the signals which are fed-forward to the succeeding stand providing the exclusive means effecting adjustments made in response to changes in the separating force.

2. An apparatus as defined in claim 1 in which the means for generating gap-error signals includes additional delay means for allowing a predetermined length of strip at the leading end thereof to pass between the rolls before the control apparatus becomes effective.

3. An apparatus as defined in claim 1 in which said gap-error signals are analog voltage signals obtained by inverting signals representative of the total separating force while the strip has normal characteristics and using the inverted signal to cancel the portion of the signal representative of the separating force not attributed to gap error.

4. An apparatus as defined in claim 1 in which said gap-error signals are analog voltage signals of varying level, and said delaying means includes a multiplexer circuit for delaying the signals in accordance with the strip speed directly without converting the signals to digital signals.

5. An apparatus as defined in claim 1 comprising in addition:

means operatively connected with the force measuring means of the stand to which gap-error signals are fed for generating feeding-forward gap-error signals to a third stand; and means for correcting the last-named gap-error signals for adjustments made in the stand to which the first-name gap-error signals were fed.

6. In a tandem strip mill which includes at least three roll stands, each of said stands comprising:

a respective pair of work rolls having a gap therebetween through which a strip passes during a rolling operation, the presence of a strip between the rolls producing a separating force on the rolls, which force varies with characteristics of the strip;

respective means for adjusting the relative position of the rolls and the size of gap therebetween; and respective means for measuring the separating force;

the combination therewith of an improved automatic gauge control apparatus comprising: p1 means operatively connected with the force-measuring means of the first of said stands for generating signals representing gap-error exclusively as indicated by changes in the separating force at the first stand;

means for feeding-forward gap-error signals from the generating means to the adjustment means of the second of said stands and effecting adjustment thereof and including means for delaying the signals to allow for transport time of the strip between stands, minus reaction time of the adjustment means of the second stand;

means operatively connected with the force-measuring means of the second stand for generating gap-error signals representative of changes in the separating force at the second stand;

means operatively connected with the adjustment means of the second stand to correct gap error signals from the force-measuring means of the second stand for adjustments made in the second stand, thus providing signals which represent gap-error exclusively; and means for feeding-forward corrected gap-error signals from the second stand to the adjustment means of the third of said stands and effecting adjustment thereof;

the rolls of said first stand being maintained at their original setting.

7. An apparatus as defined in claim 6 in which said gap-error signals are analog voltage signals obtained by inverting signals representative of the total separating force at a stand while the strip has normal characteristics and utilizing the inverted signal to cancel the portion of the signal representative of the separating force not attributed to gap error.

8. An apparatus as defined in claim 6 in which the means for generating gap-error signals includes a sample-and-hold circuit which is in its "sample" mode before a strip is between the rolls, a strip-in-stand circuit connected with said sample-and-hold circuit for shifting the latter circuit to its "hold" mode when a strip is between the rolls, a summing amplifier connected to said force measuring means and to said sample-and-hold circuit, said sample-and-hold circuit when in its "hold" mode transmitting to said summing amplifier an inverted signal of the separating force canceling the portion of the signal from said force-measuring means not attributed to gap-error.

9. An apparatus as defined in claim 8 in which the means for generating gap-error signals includes additional delay means allowing a predetermined length of strip at the leading end thereof to pass through the rolls before said strip-in-stand circuit shifts said sample-and-hold circuit to its "hold" mode.

10. An apparatus as defined in claim 8 in which said strip-in-stand circuit resets said sample-and-hold circuit to its "sample" mode when the trailing end of a strip leaves the rolls.

11. An apparatus as defined in claim 6 in which the signals fed-forward provide the exclusive means for effecting adjustments made in response to changes in the separating force.

12. In the operation of a tandem strip mill which includes a plurality of roll stands, each of which comprises:

a respective pair of work rolls having a gap therebetween through which a strip passes, the presence of the strip between the rolls producing a separating force on the rolls, which force varies with characteristics of the strip;

respective means for adjusting the relative position of the rolls and the size of gap therebetween; and respective means for measuring the separating force;

an improved method of automatically controlling the gauge of the strip, said method comprising:

feeding-forward from the force-measuring means of one or more of said stands to a succeeding stand signals representing gap-error exclusively as indicated by changes in the separating force;

delaying gap-error signals as they are fed-forward to allow for transport time of the strip from the stand at which the force is measured to the stand to which the signal is fed, minus the reaction time of the adjustment means of the latter stand; and effecting adjustments in the stand to which the signals are fed in response to changes in the roll separating force exclusively by signals fed-forward from a preceding stand.

13. A method as defined in claim 12 comprising further steps of:

measuring the separating force at the stand to which gap-error signals are fed;

feeding-forward gap-error signals from the latter stand to a third stand to effect adjustments on the third stand; and correcting the last-named gap-error signals for adjustments made in the stand to which the first-named gap-error signals were fed.

14. In the operation of a tandem strip mill which includes at least three roll stands, each of said stands comprising:

a respective pair of work rolls having a gap therebetween through which a strip passes, the presence of a strip between the rolls producing a separating force on the rolls which force varies with characteristics of the strip;

respective means operatively connected with said rolls for adjusting the relative position thereof and the size of gap therebetween; and respective means for measuring the separating force;

an improved method of automatically controlling the gauge of the strip, said method comprising:

generating in the first of said stands signals representing gap-error exclusively as indicated by changes in the separating force;

feeding-forward gauge-error signals from the first stand to the adjustment means of the second of said stands and effecting adjustment thereof but delaying the signals to allow for transport time of the strip between stands minus reaction time of the adjustment means of the second stand;

generating in the second stand gap-error signals indicated by changes in the separating force;

correcting gap-error signals from the second stand for adjustments made in the second stand to provide signals which represent gap error exclusively;

feeding-forward corrected gap-error signals from the second stand to the adjustment means of the third of said stands;

and maintaining the rolls of the first stand at their original setting.

15. A circuitfor delaying an analog voltage signal of varying level for an interval, the length of which varies with the speed of an operation to which said circuit is connected, said circuit comprising:

a voltage-controlled oscillator for generating a series of pulses the frequency of which depends on the speed of the operation;

a pulse counter operatively connected to said oscillator;

a plurality of parallel capacitors connected to said pulse counter to be charged in turn to the level of said voltage signal and discharged in turn after an interval varying with the pulse count.

16. A circuit as defined in claim 15 in which each of said capacitors is connected to receive a charage at the same time the next capacitor in line is connected to transmit a voltage.

* * * * *

UNITED STATES PATENT AND TRADEMARK OFFICE

CERTIFICATE OF CORRECTION

PATENT NO. : 4,132,095

DATED : January 2, 1979

INVENTOR(S) : Richard J. Bowman

It is certified that error appears in the above-identified patent and that said Letters Patent are hereby corrected as shown below:

Column 1, line 4, change "imroved" to -- improved --.

Column 10, line 15, change "volage" to -- voltage --.

Column 14, line 30, claim 16, change "charage" to -- charge --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*